US012543812B2

(12) United States Patent
Axelsson

(10) Patent No.: US 12,543,812 B2
(45) Date of Patent: Feb. 10, 2026

(54) SHOCK ABSORBER ASSEMBLY, PERSONAL PROTECTIVE EQUIPMENT THEREWITH, DEFORMABLE ELEMENT FOR AND METHOD OF RETROFITTING OF SUCH AN ASSEMBLY

(71) Applicant: 3M INNOVATIVE PROPERTIES COMPANY, St. Paul, MN (US)

(72) Inventor: Peter L. Axelsson, Borlänge (SE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 18/721,022

(22) PCT Filed: Dec. 20, 2022

(86) PCT No.: PCT/IB2022/062534
§ 371 (c)(1),
(2) Date: Jun. 17, 2024

(87) PCT Pub. No.: WO2023/119151
PCT Pub. Date: Jun. 29, 2023

(65) Prior Publication Data

US 2025/0057277 A1 Feb. 20, 2025

(30) Foreign Application Priority Data

Dec. 21, 2021 (EP) ..... 21216403

(51) Int. Cl.
*A42B 3/14* (2006.01)
*A42B 3/06* (2006.01)

(52) U.S. Cl.
CPC . *A42B 3/14* (2013.01); *A42B 3/06* (2013.01)

(58) Field of Classification Search
CPC .... A42B 3/14; A42B 3/06; A42B 3/12; A42B 3/145
See application file for complete search history.

(56) References Cited

U.S. PATENT DOCUMENTS 1,935,204 A 11/1933 Dym
2,879,513 A 3/1959 Hornickel et al.
(Continued)

FOREIGN PATENT DOCUMENTS

AU 2006100989 A4 12/2006
AU 2020101332 A4 8/2020
(Continued)

OTHER PUBLICATIONS

Extended European Search Report received for EP Patent Application No. 212164032, mailed on Jun. 15, 2022, 3 pages.
(Continued)

*Primary Examiner* — Tajash D Patel

(57) ABSTRACT

A shock absorber assembly (10, 10', 10") for a personal protective equipment and a deformable element (10*a*, 10*a*', 10*a*") for such a shock absorber assembly (10, 10', 10"). The shock absorber assembly (10, 10', 10") comprises a deformable element; (10*a*, 10*a*', 10*a*") exhibiting a mechanical resistance against deformation and a flexible strap (16, 17) comprising a middle portion (16*b*) and two free end portions (16*a*) facing away from each other. The middle portion (16*b*) is tightly wrapped around the deformable element (10*a*, 10*a*', 10*a*") such that pulling the free end portions (16*a*) away from each other deforms the deformable element (10*a*, 10*a*', 10*a*"). A protective helmet (100), a welding helmet (200), a face shield (400) or a respiratory device (300) comprising a hard shell (110, 210, 310, 410) and a shock absorber assembly (10, 10', 10") according to the present disclosure, wherein the hard shell (110, 210, 310, 410) of the protective helmet (100) comprises attachment means (130) for connecting the strap (16, 17) of the shock absorber assembly (10, 10', 10") to the hard shell (110, 210, 310, 410).

11 Claims, 11 Drawing Sheets

(56) References Cited

U.S. PATENT DOCUMENTS

| | | | | | |
|---|---|---|---|---|---|
| 3,018,483 | A | | 1/1962 | Austin | |
| 3,046,559 | A | | 7/1962 | Cox et al. | |
| 3,111,674 | A | | 11/1963 | Marietta | |
| 3,510,879 | A | * | 5/1970 | Webb | A42B 3/14 2/416 |
| 3,605,113 | A | * | 9/1971 | Marietta | A42B 3/14 2/420 |
| 3,609,765 | A | * | 10/1971 | Molitoris | A42B 3/14 2/418 |
| 3,758,889 | A | | 9/1973 | Erb | |
| 5,996,126 | A | * | 12/1999 | Barthold | A42B 3/14 2/416 |
| 6,817,039 | B1 | * | 11/2004 | Grilliot | A42B 3/122 2/416 |
| 6,959,783 | B2 | | 11/2005 | Kwak et al. | |
| 10,973,273 | B2 | | 4/2021 | Rietdyk | |
| 2017/0245575 | A1 | | 8/2017 | Branch | |

FOREIGN PATENT DOCUMENTS

| | | | |
|---|---|---|---|
| CA | 563124 | A | 9/1958 |
| GB | 870744 | A | 6/1961 |
| MY | 135610 | A | 5/2008 |
| WO | 2013072574 | A1 | 5/2013 |

OTHER PUBLICATIONS

International Search report for PCT International Application No. PCT/IB2022/062534, mailed on Mar. 10, 2023, 5 pages.

* cited by examiner

SHOCK ABSORBER ASSEMBLY, PERSONAL PROTECTIVE EQUIPMENT THEREWITH, DEFORMABLE ELEMENT FOR AND METHOD OF RETROFITTING OF SUCH AN ASSEMBLY

The present disclosure relates to a shock absorber assembly for a personal protective equipment comprising a deformable element and to a deformable element for such a shock absorber assembly. The present disclosure furthermore relates to a method of retrofitting such a shock absorber assembly to a personal protective equipment, preferably a protective helmet. The present disclosure moreover relates to a protective helmet, a welding helmet, a face shield or a respiratory device comprising a hard shell and such a shock absorber.

Personal protective equipment, e.g. protective helmets are commonly worn by people such as firefighters, construction workers, and athletes to shield their heads from flying or falling objects. The helmet usually includes a rigid protective shell or hard shell of impact resistant material. For some applications, the helmets may also include visors or face shields to protect the eyes or the entire face of the wearer, and may further include a respirator to protect the wearer's respiratory system.

Various government agencies and industry organizations define certain requirements and standards for protective gear, including helmets and respirators. In the United States, for example, the National Institute of Occupational Safety and Health (NIOSH) certifies certain safety equipment for the workplace and the American National Standards Institute (ANSI) recommends voluntary consensus industry standards. Other agencies and organizations around the world also establish safety standards for helmets and respirators. For personal protective equipment, in particular protective helmets, some of these standards relate to impact energy attenuation, penetration resistance, force transmission, stiffness, flammability, and head coverage.

To meet these safety requirements and standards, protective helmets usually comprise a rigid outer shell or hard shell of metal or plastic and a suspension system inside the shell. The suspension system serves many purposes, including providing a proper fit of the helmet to the wearer's head, holding the inner part of the helmet away from the wearer's head, distributing the weight of the helmet over a larger area of the wearer's head, and attenuating the force transferred to the wearer's head upon impact of an object with the outer helmet shell. Such a force attenuation may also be referred to as shock absorption. Suspension systems often comprise a headband attached to a crown support assembly which includes crisscrossing crown straps and a crown pad. Although providing some shock absorbing properties, there might be situations requiring additional impact protection. However, additional protection may be provided, e.g. by a foam liner between the inner shell and suspension of the helmet to provide additional impact protection. Such solutions may be bulky and may limit the fit of such helmets for certain users.

It is therefore a need to improve the protection provided by a personal protective equipment, in particular of protective helmets worn by users to protect their head against external impacts. In particular, it is an object of the present disclosure to provide an improved personal protective equipment with regard to external impact protection.

In a first aspect, the present disclosure relates to a shock absorber assembly for a personal protective equipment. The shock absorber assembly comprises a deformable element exhibiting a mechanical resistance against deformation and a flexible strap comprising a middle portion and two free end portions facing away from each other. The middle portion is tightly wrapped around the deformable element such that pulling the free end portions away from each other deforms the deformable element. Pulling the free end portions away from each other leads to an increase of the length s of at least one of the free end portions upon deformation of the deformable element. The kinetic energy of a falling object is introduced to the personal protective equipment, onto which the object falls. At the impact of the object, the kinetic energy is introduced to the personal protective equipment and is further being transmitted to the straps connected to the hard shell of the personal protective equipment and typically facilitating the wearing of the personal protective equipment on the head of a user or worker. Thus, the impact of the falling object onto the personal protective equipment causes pulling away of the free end portions of the straps. The kinetic energy would normally be transmitted to the user's or worker's head and may cause some impact leading to injuries there. With the shock absorber according to the present disclosure, this energy is being absorbed by the deformation of the deformable element to a greater extent compared to a personal protective equipment without the shock absorber assembly according to the present disclosure. Such an absorption includes a partial reduction as well as an entire absorption of the energy upon deformation of the deformable element. In other words, the impact to the user's head is reduced or attenuated, i.e. the impact time is being extended. It is noted that the straps, in particular the middle portions move relative to the deformable element upon deformation of the deformable element. That is, the strap moves in a sliding manner in the direction of the main extension of the strap. The advantage of such a shock absorber assembly is that a space-saving solution for shock absorption is provided. Also, the shock absorption function can easily be integrated into a headgear of a personal protective equipment, for example a protective helmet, a welding shield, a face shield or a respiratory device.

Personal protective equipment (PPE) within the meaning of the present disclosure is understood as articles for protective users or workers in a certain environment which may have some negative impact to the user or worker. PPE typically includes wearables like hearing protection, jackets, helmets of different kinds or the like. For the present disclosure, PPE mainly includes protective helmets, welding helmets, face shields or respiratory devices. Such PPE typically comprises a hard shell and is worn on or at the head of a user or worker in order to prevent the user or worker from negative impacts of object falling onto the head of a user or worker, which may cause injuries to the user or worker because of the kinetic energy of a falling object is being transmitted to the user's head without any attenuation or shock absorption otherwise. The hard shell of a PPE may exhibit some rigidity and typically has flexible straps connected to the inside of the hard shell of the personal protective equipment and contacting the user's or worker's head to maintain the position of the PPE on the user's or worker's head. Such straps may form a head gear.

"Deformation" within the meaning of the present disclosure is understood as an action or a process of deforming or distortion resulting in a change in size or shape of an object. According to this disclosure, an object is in a non-deformed condition prior to the deformation, i.e. not showing a change in size or shape, whereas a deformed condition refers to an object being deformed, i.e. having a changed size and/or shape. Such change may apply to the object as a whole or just to parts of the object. Kinetic energy introduced to the deformable element by the straps of the personal protective equipment, e.g. a protective helmet, onto which an object is falling, may introduce forces—through the hard shell and the straps connected thereto—to the deformable element causing its deformation. Upon deformation, kinetic energy is being absorbed by the change of the object's size and/or shape such that the applying energy is reduced or eliminated and does not provide negative impacts to the user's or worker's head anymore. Deformation typically includes elastic or plastic deformation. Elastic deformation is substantially reversible and the deformed element substantially returns after the deformation to its original size and shape prior to deformation. Such a deformation is also referred to as temporary or non-permanent deformation. An elastic deformation may be achieved through the use of a resilient material. In contrast thereto, plastic deformation means that the deformation is irreversible and that the deformed element does not return after the deformation to its original size and/or shape prior to deformation. The plastic deformation is also referred to as permanent deformation. A plastic deformation may be achieved through the use of a brittle material. It is noted that even in case of an elastic deformation, some plastic deformation may occur in parallel or vice versa.

"Mechanical resistance against deformation" within the meaning of the present disclosure is understood as a behavior that an object or element, here a part of the personal protective equipment, exhibits under influence of mechanical forces, i.e. forces acting upon the object or element e.g. when a deformation occurs. In particular, the object or element has the behavior to withstand the mechanical forces to some extent. An absorption of the impacting energy happens partially or entirely.

"Supported" within the meaning of the present disclosure means that the strap is laid onto the surface of the deformable element and is moveable or slidable relative to the surface of the deformable element. Supported does not include a fixed connection between the strap and the deformable element.

"Movable" or "slidable" within the meaning of the present disclosure means that a point on the strap is displaced relative to a point on the surface of the deformable element. In particular, the strap moves or slides in a direction of the main extension of the strap.

"Wrapped tightly" within the meaning of the present disclosure means that the middle portion of the strap is arranged around the deformable element such that no loose or hanging portions or hanging or sagging loops of the straps are created. In other words, the strap is in intimate contact to the surface of the deformable element.

"Shock" within the meaning of the present disclosure is understood as an impact introduced in a short period of time. "Shock absorption" is understood as a delay of that time period leading to an attenuation of the impact.

In a second aspect, the present disclosure relates to a deformable element for a shock absorber assembly for a personal protective equipment. The deformable element exhibits a mechanical resistance against deformation, wherein the deformable element is configured and arranged to support a middle portion of a strap of a personal protective equipment such that—when the strap is tightly wrapped around the deformable element—pulling the end portions of the strap away from each other deforms the deformable element. The deformable element can preferably be brought from a non-deformed condition with the length l, the thickness t, the width w and the support distances d1, d2, d3 to a deformed condition with the length l', the thickness T', the width w' and the support distances d1', d2', d3', such that the length l' is smaller than length l, the width w' is smaller than the width w, the support distance d1' is smaller than the support distance d1, the support distance d2' is smaller than the support distance d2 and/or the support distance d3' is smaller than the support distance d3. The advantage of such a shock absorber assembly is that a space-saving solution for shock absorption is provided. Also, the shock absorption function can easily be integrated into a headgear of a personal protective equipment, for example a protective helmet, a welding shield, a face shield or a respiratory device.

In a third aspect, the present disclosure relates to a protective helmet, a welding helmet, a face shield or a respiratory device comprising a hard shell and a shock absorber assembly according to the present disclosure, wherein the hard shell of the protective helmet comprises attachment means for connecting the strap of the shock absorber to the hard shell. The advantage of a protective helmet, a welding helmet, a face shield or a respiratory device with such a shock absorber assembly is that a space-saving solution for shock absorption is provided. Other advantages are listed above for the shock absorber assembly.

In a fourth aspect, the present disclosure relates to a method of retrofitting a shock absorber assembly according to the present disclosure to a personal protective equipment, preferably a protective helmet. The method comprises the steps of: providing a personal protective equipment, preferably a protective helmet, comprising a strap assembly, preferably a headgear; providing a shock absorber assembly according to the present disclosure; removing the strap assembly from the personal protective equipment and mounting the shock absorber assembly on the personal protective equipment. Such a method of retrofitting is beneficial as a standard personal protective equipment, for example a protective helmet, a welding helmet, a face shield or a respiratory device, can easily and reliably be equipped with a shock absorber function, which was not present in that personal protective equipment beforehand. An increase of safety for the user of the personal protective equipment may be achieved thereby. Other advantages are listed above for the shock absorber assembly.

In one embodiment, the deformable element of the shock absorber assembly exhibits an elongated shape having a length l, a width w perpendicular to the length l, a thickness t perpendicular to the length l and the width w and support distances d1, d2, d3 arranged on the deformable element for supporting the strap. The deformable element of the shock absorber assembly can be brought from a non-deformed condition with the length l, the thickness t, the width w and the support distances d1, d2, d3 to a deformed condition with the length l', the thickness t', the width w' and the support distances d1', d2', d3', such that the length l' is smaller than length l, the width w' is smaller than the width w, the distance d1' is smaller than the distance d1, the distance d2' is smaller than the distance d2 and/or the distance d3' is smaller than the distance d3. Such an arrangement is beneficial as the change of the dimensions length, width or the support distances may provide for a sufficient and controlled deformation and thus of a sufficient and controlled extension of the free end portions of the strap. Other advantages are listed above for the shock absorber assembly. The length of such a deformable element is greater than the width, for example the length may be 2-times, 3-times or 4-times of the width. Such an elongated shape is beneficial as it provides for an efficient use of the space available in a personal protective equipment, for example a protective helmet, a welding shield, a face shield or a respiratory device. Also, due to the elongated shape, sufficient space is provided on the deformable element such that the strap can reliably be wrapped around in a tight manner and with more than one winding.

In a further embodiment, the deformable element of the shock absorber assembly comprises a main body and an opening formed therein, wherein the main body and/or the opening are deformed upon deformation of the deformable element. The arrangement of an opening formed within the main body of the deformable element provides for a reliable and sufficient deformation of the deformable element when pulling the free end portions away from each other. The opening may undergo a reduction of size and/or an alteration of shape which facilitates a sufficient deformation of the deformable element.

In one embodiment, the length l of the deformable element of the shock absorber assembly decreases upon deformation of the deformable element. Such a deformable element is beneficial as it provides for a reliable and sufficient deformation of the deformable element when pulling the free end portions away from each other.

In a further embodiment, the width w of the deformable element of the shock absorber assembly decreases upon deformation of the deformable element. Such a deformable element is beneficial as it provides for a reliable and sufficient deformation of the deformable element when pulling the free end portions away from each other.

In a further embodiment, the thickness t of the deformable element of the shock absorber assembly decreases upon deformation of the deformable element. Such a deformable element is beneficial as it provides for a reliable and sufficient deformation of the deformable element when pulling the free end portions away from each other.

In yet a further embodiment, at least one of the support distances d1, d2, d3 of the deformable element of the shock absorber assembly decreases upon deformation of the deformable element. Such a deformable element is beneficial as it provides for a reliable and sufficient deformation of the deformable element when pulling the free end portions away from each other.

It is conceivable that the deformable element is configured and arranged such that one, several or all the dimensions, for example the length l, the width w and/or the support distances d1, d2, d3 decrease upon deformation. Such a deformable element is beneficial as it provides for a reliable and sufficient deformation of the deformable element when pulling the free end portions away from each other.

In one embodiment, the middle portion of the strap is supported by the deformable element of the shock absorber assembly. Such an arrangement is of advantage as the strap is reliably and securely arranged at the deformable element thereby.

In another embodiment, the two free end portions of the strap each protrude from the deformable element of the shock absorber assembly. Such an arrangement provides for some design variations within the personal protective equipment, e.g. a protective helmet, as the protruding portions provide for a good fit of the personal protective equipment with such a shock absorber assembly onto the user's or worker's head.

In a further embodiment, the strap of the shock absorber assembly exhibits a tensile strength of 1200 to 1800 N. Such a tensile strength of the strap provides for a reliable and secure personal protective equipment.

In another embodiment, the strap and the deformable element of the shock absorber assembly form a head gear. Such an assembly is of advantage as the shock absorber assembly can replace the head gear of a personal protective equipment, for example a protective helmet, a welding helmet, a face shield or a respiratory device, and provide for a shock absorber function of such a personal protective equipment originally not having that function. In other words, such a head gear with a shock absorber according to the present disclosure can easily be retrofitted to an existing personal protective equipment, for example of the type as mentioned above as the original head gear can be removed and be replaced by such a head gear according to the present disclosure at once or as a whole.

In one embodiment, the deformable element of the shock absorber assembly comprises strap guiding means for guiding the strap at the deformable element, wherein the strap guiding means preferably comprises a guiding arm arranged such that a slot for receiving the strap is formed between the guiding arm and the main body of the deformable element. Such a guiding arm and such a slot may be formed such that the slot is open on one end thereof. It is also conceivable that the slot is closed on both ends. The guiding arm may protrude from the perimeter of the deformable element or may protrude from the major surface of the deformable element. A strap guiding means is of advantage as guiding of the strap on the deformable element provides for a reliable and secure assembly. An unwanted movement of the strap, for example in a direction transverse to the main extension of the strap, is prevented thereby while still allowing for movement in the main extension direction of the strap, which is required for the function of the shock absorber assembly.

In another embodiment, the strap of the shock absorber assembly is made of a woven textile. Such a structure has the advantage that the strap exhibits the required properties with regard to tensile strength, flexibility and manufacturing costs.

In another embodiment, the strap of the shock absorber assembly comprises polypropylene, polyester or polyamide. Such a material has the advantage that the strap exhibits the required properties with regard to tensile strength, flexibility and manufacturing costs.

In yet another embodiment, the strap of the shock absorber assembly comprises a twisted portion when wrapped around the deformable element such that the strap exhibits a 180 degrees twist at the deformable element, wherein the strap preferably comprises two twisted portions. As a result of the twisted portion, the strap turns from a first major surface of the deformable element to a second major surface of the deformable element. Such an arrangement with a twisted portion provides for a strap which has a sufficient length of the middle portion wrapped around the deformable element. A sufficient increase of the length of the free end portions of the strap protruding from the deformable element is achieved thereby as more than one layer of the strap on the deformable element can move.

In still another embodiment, the shock absorber assembly comprises two flexible straps each comprising a middle portion and two free end portions facing away from each other. The middle portion is tightly wrapped around the deformable element such that pulling the free end portions away from each other deforms the deformable element. The middle portions of the two straps at least partially overlap with each other. The advantage of such an assembly with two straps is that a good fit of the personal protective equipment is provided when worn by a user.

In one embodiment, the deformable element of the shock absorber assembly comprises a resilient material and wherein the deformation of the deformable element is reversible. Such a resilient material for the deformable element is beneficial as the deformable element may return to its original shape after release of the load, which may provide for a re-usable shock absorber assembly.

In a certain embodiment, the resilient material of the deformable element of the shock absorber assembly is selected from polycarbonate, polyethylene, preferably high-density polyethylene, acrylonitrile-butadiene-styrene. Such a material is advantageous because it provides for reliable properties of the deformable element regarding the deformation and the return to the original shape.

In one embodiment, the deformable element of the shock absorber assembly comprises a brittle material and wherein the deformation of the deformable element is irreversible. Such a brittle material facilitates an irreversible deformation of the deformable element. This may be useful to provide an indicator function to the user of the personal protective equipment, i.e. an indication to the user that the deformable element has been deformed. Also, an unwanted re-use of the shock absorber assembly may be prevented thereby.

In a certain embodiment, the brittle material of the deformable element of the shock absorber assembly is selected from polystyrene, polyvinyl chloride, acrylic materials. Such a material is advantageous because it provides for reliable properties of the deformable element regarding deformation and further supports the indication function to the user about a load acting on the strap.

In another embodiment, the thickness t of the deformable element of the shock absorber assembly is in the range of 0.1 to 5 mm in a non-deformed condition. Such a thickness is of advantage as it provides for a space-saving arrangement of the deformable element within a personal protective equipment, for example a protective helmet, on the one hand and for a reliable and stable design of the deformable element on the other hand.

In one embodiment, the shock absorber assembly comprises an indicator for indicating a deformation of the deformable element. Such an indicator is of advantage as it provides for a reliable indication—independent of the optical appearance of the deformable element—of a deformation of the deformable element which has happened upon acting of a load on the personal protective equipment. In other words, even if the deformation of the deformable element is not visible to the user (any longer), e.g. a deformable element which is elastically deformable and the deformation of the deformable element is reversible, respectively, there is an indication to the user of a deformation that has happened. In some countries, personal protective equipment may underlie regulatory aspects and such a regulation may require that there is a reliable indication about a shock absorber that has been activated.

In a certain embodiment, the indicator of the shock absorber assembly has a load threshold value for the load impact and wherein the indicator indicates the load impacting onto the deformable element above the load threshold, wherein the load threshold value is preferably between 500 N and 10 kN. It is noted that there may specific values be set for specific personal protective equipment depending on demand in the geographic area. Such a load threshold value is of advantage as the indicator does not indicate low impacts, i.e. impacts of a low load which may be considered uncritical. An indication provided by such an indicator means that the load was reasonably high and therefore it is important that the user is being informed about that.

In certain embodiments, the indication of the indicator of the shock absorber assembly is irreversible. Tat means that the indicator undergoes a shape, size and/or appearance change which irreversibly indicates a deformation of the deformable element of the shock absorber assembly to which the indicator belongs or to which the indicator is attached to. Such an indicator is beneficial as the indication is permanently observable even if the deformable element is elastically deformable and returns to its shape and appearance after the load impact. Such an irreversible indicator may comprise an ink or a paint arranged on the surface of the deformable element, wherein the ink or paint exhibits optical defects after a load impact, e.g. cracks. It is also conceivable that the indicator comprises a mechanical indicator element, e.g. a thread or other thin structure which ruptures when a load impacted on the shock absorber.

In certain embodiments, the indicator of the shock absorber assembly is attachable to the deformable element. Such an attachable indicator has the advantage that it can be replaced after indication and the deformable element is still usable with a new indicator. This is particularly useful if the deformable element is elastically deformable and the deformation is reversible. Also, the indicator may be replaced by another one, i.e. an indicator with different properties, e.g. different sensitivity. The shock absorber assembly and/or the indicator may comprise attachment means for attaching the indicator to the deformable element of the shock absorber assembly. The attachment means may comprise a mechanical attachment means such as mechanical fasteners, snap fit or the like, an adhesive attachment means such as an adhesive layer or a combination thereof. The advantage of such an attachment means is that an easy and reliable way of attaching the indicator to the deformable element of the shock absorber is provided thereby.

In a certain embodiment, the indicator of the shock absorber assembly is integral with the deformable element. For example, the indicator is formed as a protrusion of an edge of the deformable element, which may protrude from the edge into an opening present at the deformable element of the shock absorber assembly. Other arrangements are conceivable as well, for example an indicator arranged on the surface of the deformable element or protruding from an outer edge of the deformable element. Such an integral indicator has the advantage that no attachment means are required. Also, an easy, compact and robust arrangement of the indicator is provided thereby. Furthermore, an unwanted replacement of the indicator is prohibited thereby, which may in particular be required by regulations.

In one embodiment of the method of retrofitting a shock absorber assembly according to the present disclosure to a personal protective equipment, the personal protective equipment is a protective helmet, a welding helmet, a face shield or a respiratory device. Such a method of retrofitting is beneficial as a standard personal protective equipment, for example a protective helmet, a welding helmet, a face shield or a respiratory device, can easily and reliably be equipped with a shock absorber function, which was not present in that personal protective equipment beforehand. In particular, retrofitting the shock absorber assembly to a protective helmet, a welding shield, a face shield or a respiratory device provides an increased level of safety for such personal protective equipment.

The invention was described in various embodiments above. It is understood by a person skilled in the art, that one of, several of or all the above-mentioned embodiments can be combined with each other.

The invention will now be described in more detail with reference to the following Figures exemplifying particular embodiments of the invention:

BRIEF DESCRIPTION OF THE DRAWINGS

FIG. 1 is a schematic top view of an embodiment of the deformable element 10*a* of the shock absorber assembly 10 according to the present disclosure. The shock absorber assembly 10 comprises a deformable element 10*a* having an elongated shape with a length l and a width w perpendicular to the length l. In the embodiment shown, the length l is approximately 3 times of the width w. Although not shown here, other configurations are conceivable with a different length-to-width ratio. The deformable element 10*a* of the shock absorber assembly 10 comprises a main body 12 and an opening 14 formed therein. The opening 14 may be formed by cutting out or punching the material of the main body 12. Alternatively, the main body 12 may be formed in a molding process, e.g. an injection molding process, wherein the opening 14 is directly formed together with the main body 12 in such a process. Upon deformation of the deformable element 10*a*, the main body 12 and/or the opening 14 will change their shape and appearance (not shown in FIG. 1, see FIGS. 7 and 8 or FIGS. 9 and 10). The shock absorber assembly 10 further comprises two flexible straps 16, 17, which are not shown here (please see FIG. 2). At the upper and lower perimeter of the deformable element 10*a*, towards the transverse sides of the deformable element 10*a*, strap guiding means 20 are arranged for guiding the straps 16, 17 (not shown) at the deformable element 10*a*. The strap guiding means 20 are explained in more detail below in FIG. 2. The deformable element 10*a* of the shock absorber assembly 10 as shown further comprises an indicator 30 for indicating a deformation of the deformable element 10*a* that has happened. As can be seen, the indicator 30 comprises two protrusions 32*a*, 32*b* extending from the inner perimeter of the deformable element 10*a* into the opening 14. The protrusions 32*a*, 32*b* are connected to each other by connection 32*c*. A deformation of the deformable element 10*a* will lead to a movement of the protrusions 32*a*, 32*b* relative to each other such that the connection 32*c* therebetween is released, e.g. by breaking. Such a release can be observed, e.g. optically, by a user. The deformable element 10*a* also shows a further indicator 36, which may be arranged in addition to the indicator 30 or as an alternative thereto. In the example shown, the indicator 36 comprises an ink or paint which is arranged on the surface of the deformable element 10*a*. A deformation of the deformable element 10*a* leads to damage of the surface of the ink or paint such that cracks or the like occur. The indicator 36 in the example shown exhibits cracks 38 which occurred upon a deformation the deformable element 10*a* did undergo. Such cracks 38 can be observed, e.g. optically, by a user.

FIG. 2 is a schematic top view of an embodiment of the shock absorber assembly 10 according to the present disclosure. Similar to FIG. 1, the shock absorber assembly 10 comprises a deformable element 10*a* and has an elongated extension. The deformable element 10*a* comprises a main body 12 and an opening 14 formed therein. In addition to what is shown in FIG. 1, the shock absorber assembly 10 further comprises two flexible straps 16, 17 each having a middle portion 16*b* which is tightly wrapped around the deformable element 10*a* and two free end portions 16*a* facing away from each other. The middle portion 16*b* of the straps 16, 17 is supported by the deformable element 10*a*. A part of the middle portion 16*b* of the strap 16 is on a first major surface of the deformable element 10*a*. The strap 16 further comprises two twisted portions 16*c* at which the strap 16 turns from a first major surface of the deformable element 10*a* to a second major surface opposite to the first major surface such that a part of the middle portion of the strap is on the opposite second major surface (underneath the deformable element 10*a* and thus not visible here) and vice versa. Although two twisted portions 16*c* are indicated in FIG. 2, it is noted that there may be more than two twisted portions 16*c* present at the straps 16, 17 depending on the number of windings of the strap 16 around the deformable elements 10*a* when tightly wrapping the strap 16 around the deformable element 10*a*. In the example shown in FIG. 2, there are two straps 16, 17 each with a middle portion 16*b* tightly wrapped around the deformable element 10*a*. As can be seen, the middle portions 16*b* of the two straps 16, 17 overlap with each other three times, i.e. two times on the first major surface (in FIG. 2 the top side) of the deformable element 10*a* and one time on the second major surface thereof (in FIG. 2 the rear side, thus not visible here). Other configurations are conceivable, e.g. having more or less overlaps of the middle portions 16*b* of the straps 16, 17. Pulling the free end portions 16*a* of a strap 16 away from each other deforms the deformable element 10*a* (deformation not shown here, see FIGS. 7 and 8 or 9 and 10). The free end portions 16*a* of the straps 16, 17 each have a free length s protruding from the deformable element 10*a*. The free end portion 16*a* is not supported by the deformable element 10*a*. Upon deformation of the deformable element 10*a*, the middle portion 16*b* of the straps 16, 17 moves relative to the surface of the deformable element 10*a* in a direction along the extension of the strap 16. In other words, the middle portion 16*b* slides on the surface of the deformable element 10*a* such that the length s of the free end portion 16*a* protruding from the deformable element 10*a* increases to the free length s' (not shown here, see FIGS. 9 and 10). Similar to FIG. 1, the deformable element 10*a* comprises strap guiding means 20 which is formed by a guiding arm 22 defining a slot 24 for receiving the strap 16. As shown, the strap 16 extends through the slot 24 and is kept in place by the guiding arm 22. It is noted that the contact between the guiding arm 22 and the strap 16 is tight, but not so strong that a movement of the strap through the slot 24 of the guiding means 20 is substantially inhibited. Such a strap guiding means 20 with its guiding arm 22 may be formed by cutting out a portion of the main body 12 of the deformable element 10*a* to form the slot 24 and thereby the guiding arm 22. It is also conceivable to make the strap guiding means 20 by a molding process, e.g. an injection molding process, preferably at the same time when the main body 12 of the deformable element 10*a* is formed.

FIG. 3 is a schematic perspective view of a protective helmet 100 comprising a hard shell 110 and a shock absorber assembly 10 according to the present disclosure. The shock absorber assembly 10 is only partially visible here (a part of a strap forming the head gear is visible at the rear side of the protective helmet 100) as it is attached to the inside of the hard shell 110.

FIG. 4 is a schematic perspective view of a welding helmet 200 comprising a hard shell 210, a protective visor 220 and a shock absorber assembly 10 according to the present disclosure. The shock absorber assembly 10 is only partially visible here (a part of a strap forming the head gear is visible at the rear side of the welding helmet 200) as it is attached to the inside of the hard shell 210.

FIG. 5 is a schematic perspective view of a respiratory device 300 comprising a hard shell 310, a protective visor 320 and an air supply connection connecting 330 the respiratory device 300 with an air supply unit (not shown here). The respiratory device 300 further comprises a shock absorber assembly 10 according to the present disclosure. The shock absorber assembly 10 is only partially visible here (a part of a strap forming the head gear is visible at the lower rear side of the respiratory device 300) as it is attached to the inside of the hard shell 310.

FIG. 6 is a schematic perspective view of a face shield 400 comprising a hard shell 410, a protective visor 420 and a shock absorber assembly 10 according to the present disclosure. The shock absorber assembly 10 is only partially visible here (a part of a strap forming the head gear is visible at the lower rear side of the face shield 400) as it is attached to the inside of the hard shell 410.

FIG. 7 is a schematic top view of the deformable element 10*a* of the shock absorber assembly 10 according to the present disclosure in a non-deformed condition. The deformable element 10*a* has—prior to deformation, i.e. in a non-deformed condition—a width w. The straps 16, 17 are only schematically illustrated here as arrows, wherein the strap 16 has two free end portions 16*a* each with a free end length s (only indicated for one strap 16 here). FIG. 7 further illustrates the support distances d1, d2, d3 over which the middle portion 16*b* (not shown here) of the straps 16 is supported by the deformable element 10*a*.

FIG. 8 is a schematic top view of the deformable element 10*a* of the shock absorber assembly 10 in a deformed condition, e.g. when a load had acted or is acting on the straps 16, 17 such that the free end portions 16*a* of the strap 16 are pulled away from each other. FIG. 8 further illustrates the reduced support distances d1', d2', d3' over which the middle portion 16*b* of the straps is supported by the deformable element 10*a*. The deformable element 10*a* has—in the deformed condition—a width w'. Due to the deformation of the deformable element 10*a*, the width w' is smaller than the width w of the deformable element 10*a* in the non-deformed condition as illustrated in FIG. 7 above. The straps 16, 17 are only schematically illustrated here as arrows, wherein the strap 16 has two free end portions 16*a* with a prolonged free end length s' (only one is indicated here). This is because the middle portion 16*b* of the strap 16 has moved relative to the surface of the deformable element 10*a* and at least one of the support distances d1', d2', d3', over which the strap 16 is supported on the deformable element 10*a*, has been decreased. In the example shown, in particular support distance d1' has been decreased in the deformed condition of the deformable element 10*a* relative to the support distance d1 of the deformable element 10*a* in the non-deformed condition as shown in FIG. 7. This leads to an increase in length s' compared to the length s in FIG. 7. Although not illustrated here, other dimensions may also be decreased, e.g. the length l' or the support distances d2', d3' relative to the length l or the support distances d2, d3 as shown on FIG. 7, at the same time.

FIGS. 9 and 10 are schematic top views of the shock absorber assembly 10 with its deformable element 10*a* and with two straps 16, 17 arranged on the deformable element 10*a* such that the middle portion 16*b* is tightly wrapped around the deformable element 10*a*. As can be seen, the straps 16, 17 each further comprise two free end portions 16*a* (only one of which is indicated with 16*a*) having a free end length s as well as two twisted portions 16*c*. FIGS. 9 and 10 further show four attachment means 120 (only one of which is indicated with 120) arranged at the free end portion 16*a* of the strap 16 for attaching the shock absorber assembly 10 to a personal protective equipment, for example a protective helmet, a welding helmet, a face shield or a respiratory device (not shown here). It is understood, although not shown, that all the free end portions 16*a* of the straps 16, 17 may comprise such attachment means 120. The attachment means 120 may engage with corresponding attachment means 130 of the personal protective equipment (both not visible here), e.g. a protective helmet 100 as shown in FIG. 13. Similar to FIGS. 7 and 8, FIGS. 9 and 10 show the deformable element 10*a* and the dimensions width w and the support distances d1, d2, d3 in the non-deformed condition (FIG. 9) and the dimensions width w' and the support distances d1', d2', d3' in the deformed condition (FIG. 10) of the deformable element 10*a*. As can be seen from FIGS. 9 and 10, the width w' and the support distances d1', d2', d3' of FIG. 10 are smaller compared to the width w and the support distances d1, d2, d3 of FIG. 9. Although not illustrated in FIGS. 9 and 10, also the length l of the deformable element 10*a* in the non-deformed condition (FIG. 9) may decrease to the length l' of the deformable element 10*a* in the deformed condition (FIG. 10). Similar to FIGS. 7 and 8, FIGS. 9 and 10 illustrate free end length s of the strap 16 when the deformable element 10*a* is in a non-deformed condition (FIG. 9) which increases to the free end length s' of the strap 16 when the deformable element 10*a* is in a deformed condition (FIG. 10). It is noted that—although such an arrangement is only illustrated for one free end 16*a* of the strap 16—the other free ends may similarly exhibit an increased free end length s' of the free end portion 16 of the straps 16, 17 when the deformable element 10*a* is in the deformed condition relative to the free end length s of the free end portion 16*a* of the straps 16, 17 when the deformable element 10*a* is in the non-deformed condition.

FIGS. 11 and 12 are schematic perspective views of a protective helmet 100 with a shock absorber assembly 10 (in dotted lines as it is arranged inside of the hard shell 110 of the protective helmet 100). As can be seen, the shock absorber assembly 10 is arranged such that a distance d occurs between the inner surface of the hard shell 110 and the deformable element 10*a* of the shock absorber assembly 10, when the deformable element 10*a* is in the non-deformed condition (FIG. 11). Distance d decreases to the distance d' when the deformable element 10*a* of the shock absorber assembly 10 is in the deformed condition (FIG. 12). This is because the free end length s when the deformable element 10*a* is in the non-deformed condition (FIG. 11), of one, some or all the straps 16, 17 have been increased, to the free end length s', when the deformable element is in the deformed condition (FIG. 12).

FIG. 13 is a schematic bottom view of a protective helmet 100 with the shock absorber assembly 10 attached to the inside of the hard shell 110 of the protective helmet 100. As can be seen, the free ends 16*a* of the straps 16, 17 of the shock absorber assembly 10 comprise attachment means 120 which engage with corresponding attachment means 130 of the hard shell 110 of the protective helmet 100. FIG. 13 shows the attachment means 120, 130 in the engaged condition. It is noted that the attachment means 120, 130 may provide a release connection to each other such that the shock absorber assembly 10 can be removed from the protective helmet 100, e.g. for replacement by a different shock absorber assembly or another head gear. It is also noted that the protective helmet 100 may initially not have had a shock absorber assembly 10 according to the present disclosure.

Due to the releasable attachment means 130, the shock absorber assembly 10 may have been retrofitted to the protective helmet 100 by removing the initial assembly, e.g. a standard head gear without shock absorption, by disconnecting its attachment means from the attachment means 130 of the protective helmet 100 and replacing the initial assembly with the shock absorber assembly 10 according to the present disclosure by connecting the attachment means 120 with the corresponding attachment means 130 of the protective helmet 100. It is also conceivable that the connection between the attachment means 120 of the shock absorber assembly 10 and the attachment means 130 of the protective helmet 100 is permanent, i.e. not releasable or disconnectable. FIG. 13 further shows details of the deformable element 10*a* and the straps 16, 17 similar to the shock absorber assembly 10 as shown in FIGS. 2 and 9.

FIGS. 14 and 15 are schematic top views of the deformable element 10*a*' according to a further embodiment of the shock absorber assembly 10. The deformable element 10*a*' of FIGS. 14 and 15 is generally similar to the deformable element 10*a* as shown in FIG. 1 except that the indicator 30' here is different compared to the indicator 30 as shown on FIG. 1. The indicator 30' is separate from the deformable element 10*a*' here, whereas the indicator 30 shown in FIG. 1 is integral with the main body 12 of the deformable element 10*a*. The deformable element 10*a*' as shown here also comprises a main body 12' and an opening 14' formed therein. Shape and function of the main body 12' and the opening 14' as shown here is similar to the main body 12 and the opening 14 as shown in FIG. 14. The indicator 30' comprises two protrusions 32*a*', 32*b*' into an opening 32' formed within the indicator 30'. The two protrusions 32*a*', 32*b*' are connected to each other by connection 32*c*', which is being released upon deformation of the deformable element 10*a*' (not shown here). The indicator 30' further comprises attachment means 34*a*' for engaging with corresponding attachment means 34*b*' arranged on the main body 12' of the deformable element 10*a*' for attaching the indicator 30' to the deformable element 10*a*'. It is noted that the attachment may be releasable, i.e. disconnectable, or non-releasable, i.e. permanent or not disconnectable. FIG. 15 shows the indicator 30' attached to the main body 12' of the deformable element 10*a*' with the attachment means 34*a*' and 34*b*' engaged with each other. FIGS. 14 and 15 show four attachment means 34*a*', 34*b*'. Other configurations with more or less attachment means are conceivable as well. A further alternative of attachment means is shown below in FIGS. 17A, 17B, 18A and 18B. It is noted that the details of the shock absorber assembly 10 as shown above are also conceivable to be present here.

FIGS. 16A and 17A are schematic top views of the deformable element 10*a*" with alternative attachment means 34" for the indicator 30". The indicator 30" is similar in structure and function re. the indicator 30, 30' as shown in FIGS. 1, 14 and 15 above, i.e. the indicator 30" comprises two protrusions 32*a*", 32*b*" extending into an opening 32" and connected to each other by a connection 32*c*". Similar to the above-described indicators 30, 30', the connection 32*c*" of indicator 30" is being released upon deformation of the deformable element 10*a*". As can be seen, the indicator 30" does not have explicit attachment means arranged thereon except the outer perimeter region 34*a*" thereof, which is engaged by attachment means 34" of the main body 12" of the deformable element 10*a*". FIG. 16A shows the indicator 30" in a not-attached condition, whereas FIG. 17A shows the indicator 30" attached to the main body 12" of the deformable element 10*a*". In this attached condition, the attachment means 34" with its two legs 34*b*' forming a gap 34*c*" therebetween engage the outer perimeter region 34*a*" of the indicator 30". It is noted that the thickness of the indicator element 30" and the gap 34*c*" between the two legs 34*b*" of the attachment means 34" are configured and arranged such that—when the indicator 30" is attached and the outer perimeter region 34*a*" is introduced into the gap 34*c*", a tight fit or clamping is provided in order to keep the indicator 30" securely in place. Other configurations are conceivable as well, for example an increased friction of the surfaces to enhance the attachment. It is also conceivable to provide an adhesive between the surfaces to further enhance the attachment. Similar to FIGS. 1, 14 and 15, an opening 14" formed in the main body 12" of the deformable element 10*a*" is shown here. Shape and function of the main body 12" and the opening 14" as shown here is similar to the main body 12, 12' and the opening 14, 14' of the deformable elements 10*a*, 10*a*' as shown in FIGS. 1, 14 and 15. FIGS. 16B and 17B illustrate in a schematic side view the main body 12" with the attachment means 34" (FIG. 16B) and the engagement of the outer perimeter region of the indicator 30" by the attachment means 34". As can be seen, the attachment means 34" has two legs 34*b*" forming a gap 34*c*" therebetween for receiving the outer perimeter region 34*a*" of the indicator 30" (FIG. 17B). As mentioned above, the attachment means 34" and the outer perimeter region 34*a*" of the indicator 30" are configured and arranged to provide a reliable fit such that the indicator 30" is securely kept in place. It is noted that the attachment may be releasable, i.e. disconnectable, or non-releasable, i.e. permanent or not disconnectable. It is also noted that the details of the shock absorber assembly 10,10' as shown above are also conceivable to be present here.

FIGS. 18A and 18B are schematic top views of the indicator 30' as illustrated above in FIGS. 14 and 15. FIG. 18A shows the indicator 30' in a first condition, i.e. prior to the deformation of the deformable element 10*a*' of the shock absorber assembly 10' (both not shown here), i.e. with the deformable element 10*a*' in a non-deformed condition. As can be seen, the connection 32*c*' between the two protrusions 32*a*', 32*b*' is intact. FIG. 18B shows the indicator 30' in a second condition when a deformation of the deformable element 10*a*' of the shock absorber assembly 10' has happened, i.e. with the deformable element 10*a*' in a deformed condition. Here, the connection 32*c*' has been broken as indicated by the two remaining portions 33*a*', 33*b*', which previously had formed the connection 32*c*'. Although the details of the connection 32*c*' are illustrated for the separate indicator 30' here, the same applies to other indicators 30, 30", for example an alternative separate indicator 30" as shown in FIGS. 16A, 17A or an integrated indicator 30 as shown in FIG. 1. It is further noted that the connection 32*c*, 32*c*', 32*c*", which is formed as a bar between the two protrusions 32*a*, 32*b*, 32*a*', 32*b*', 32*a*", 32*b*" and which may be integral with these, may be formed in a different way. For example, the connection 32*c*, 32*c*', 32*c*" may have a different shape and/or may be a separate part which is attached to the two protrusions 32*a*, 32*b*, 32*a*', 32*b*', 32*a*", 32*b*". Suitable attachment means may be present in such a case. It is noted that the details of the shock absorber assembly 10, 10', 10" as shown above are also conceivable to be present here.

Figure 1:
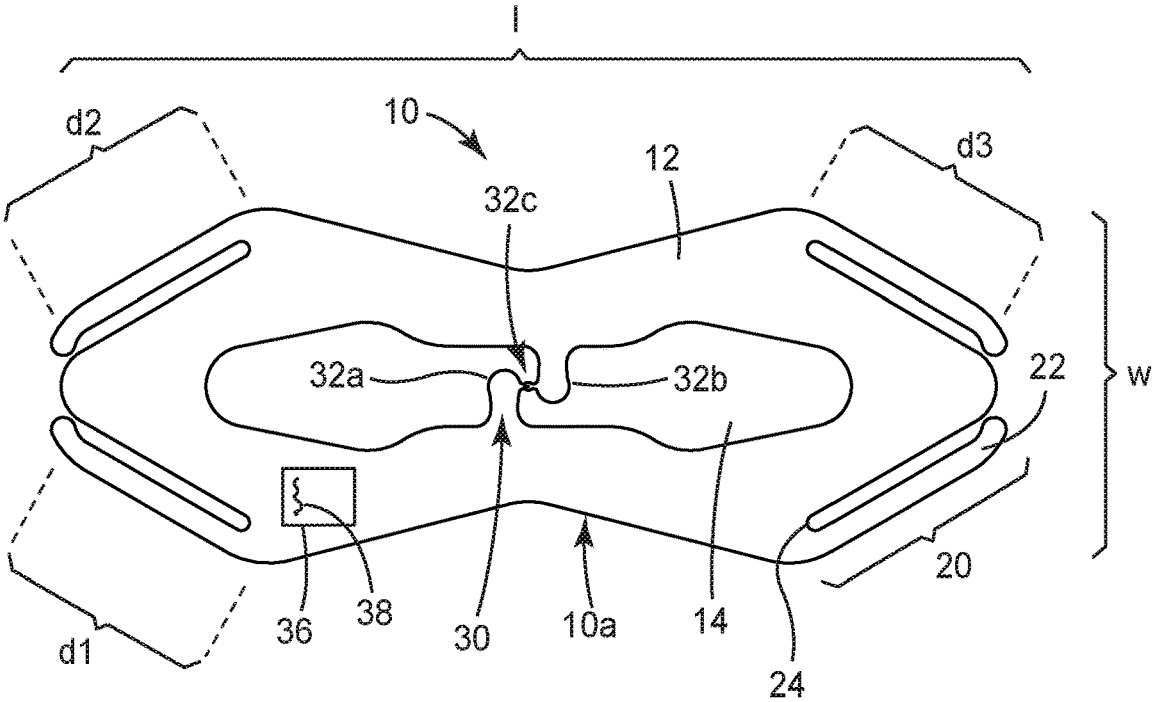
FIG. 1 is a schematic top view of an embodiment of the deformable element of the shock absorber assembly according to the present disclosure.
Figure 2:
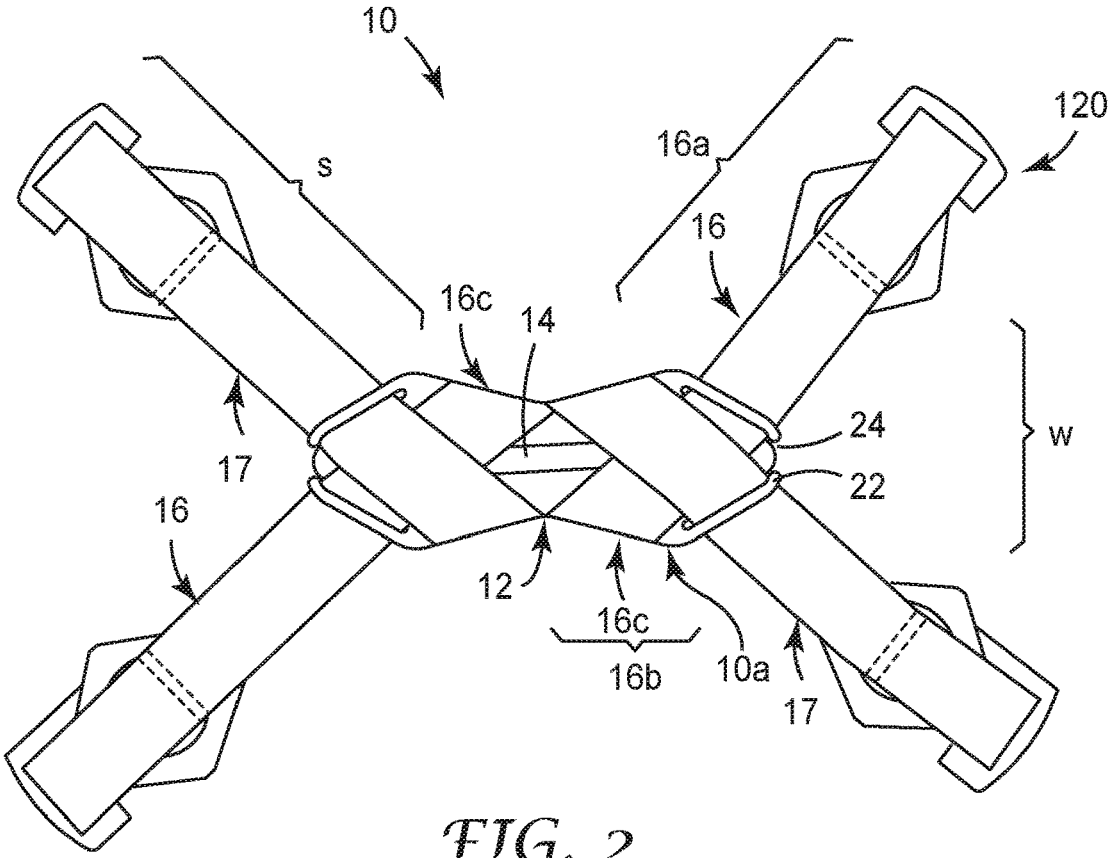
FIG. 2 is a schematic top view of an embodiment of the shock absorber assembly according to the present disclosure with two flexible straps assembled to the deformable element.
Figure 3:
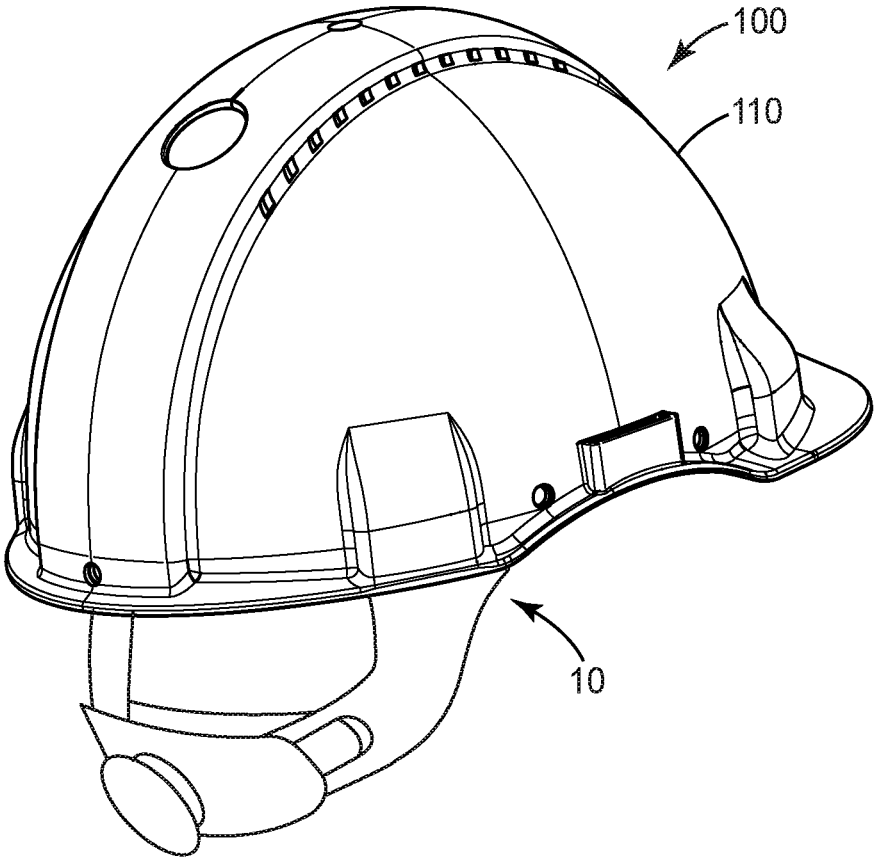
FIG. 3 is a schematic perspective view of a protective helmet with the shock absorber assembly according to the present disclosure.
Figure 4:
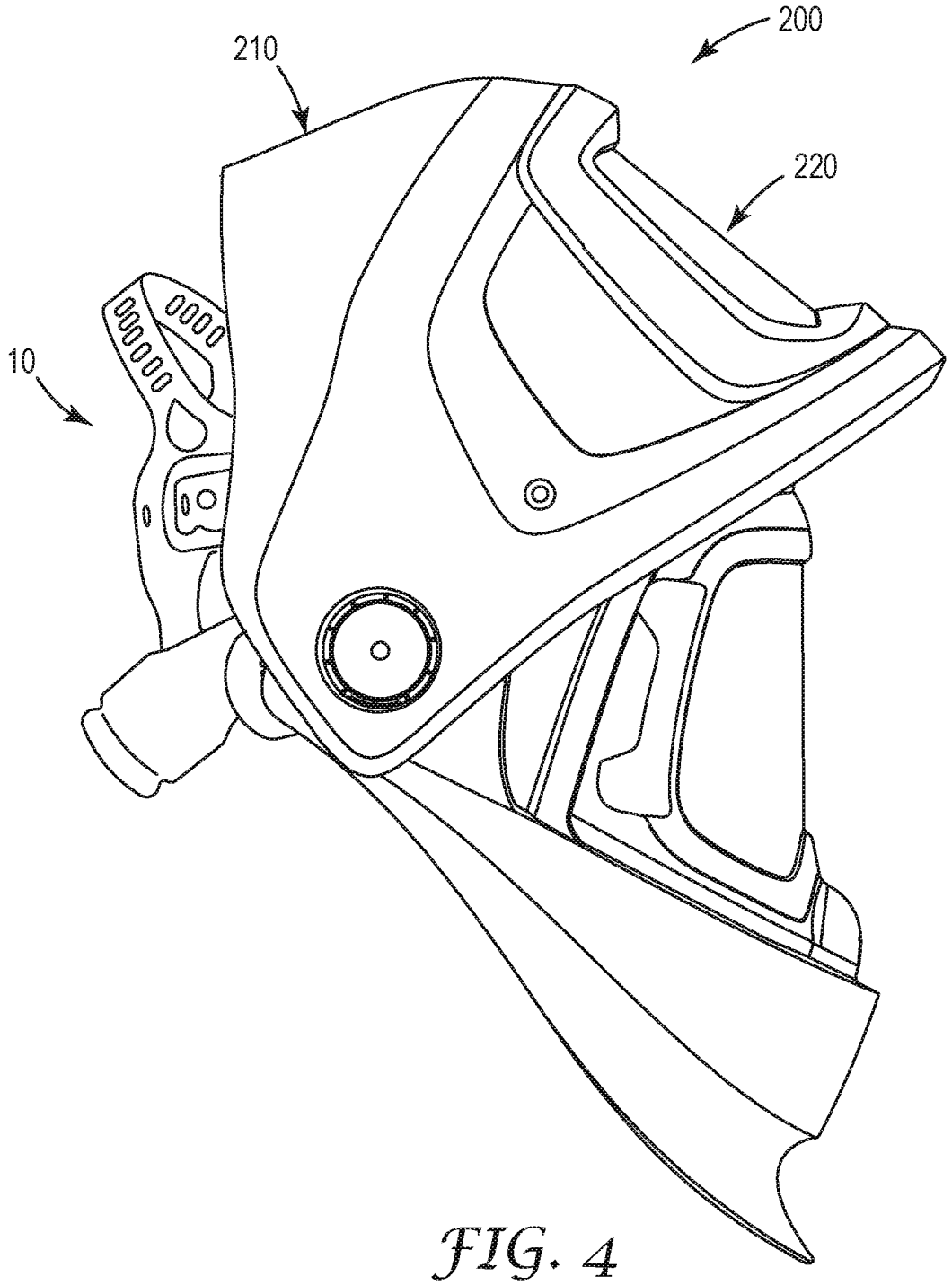
FIG. 4 is a schematic perspective view of a welding helmet with the shock absorber assembly according to the present disclosure.
Figure 5:
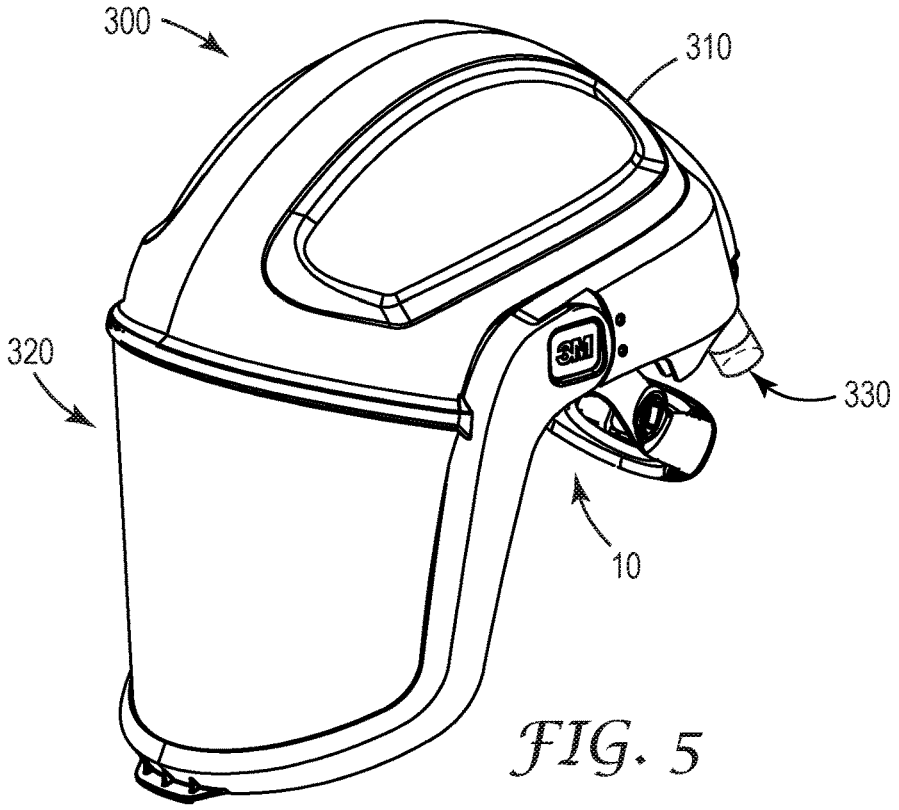
FIG. 5 is a schematic perspective view of a respiratory device with the shock absorber assembly according to the present disclosure.
Figure 6:
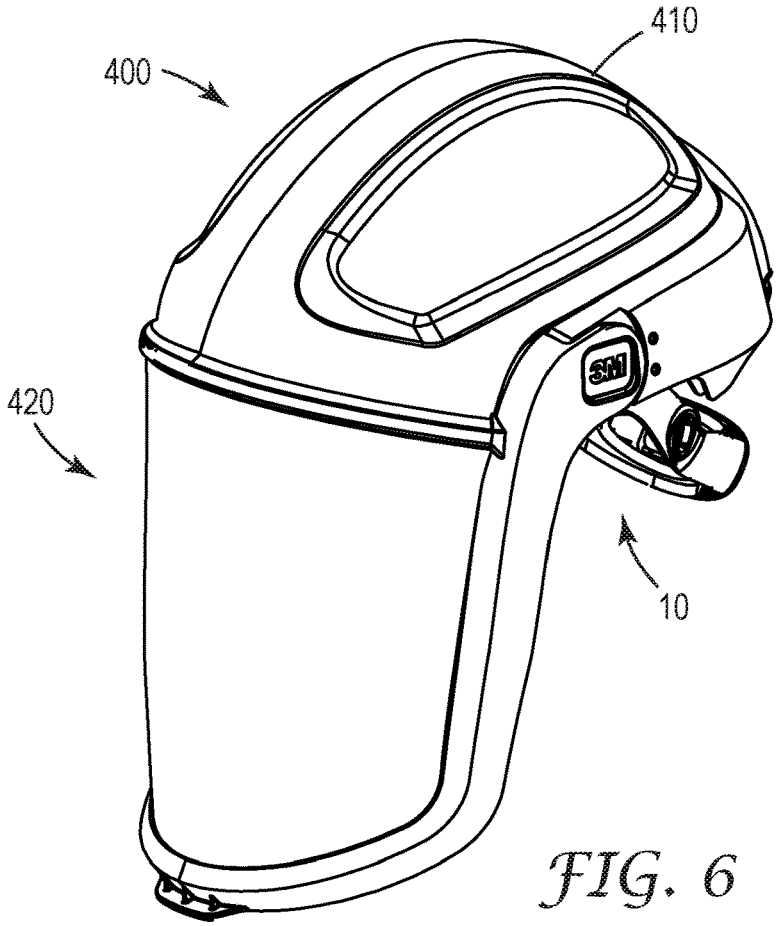
FIG. 6 is a schematic perspective view of a face shield with the shock absorber assembly according to the present disclosure.
Figure 7:
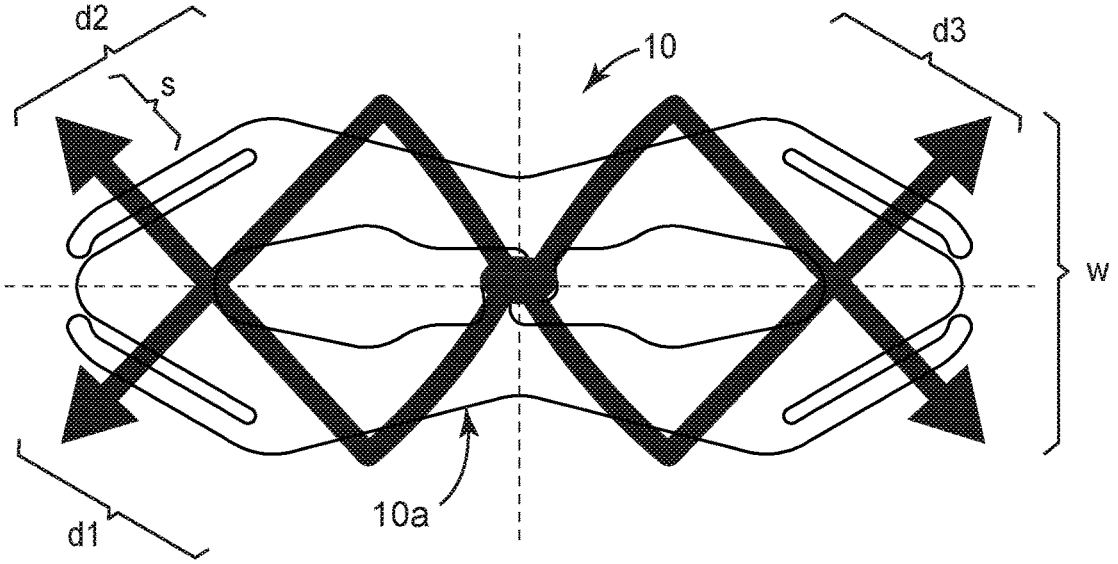
FIG. 7 is a schematic top view of the deformable element of the shock absorber assembly as shown in FIG. 1 with the deformable element being in a non-deformed condition.
Figure 8:
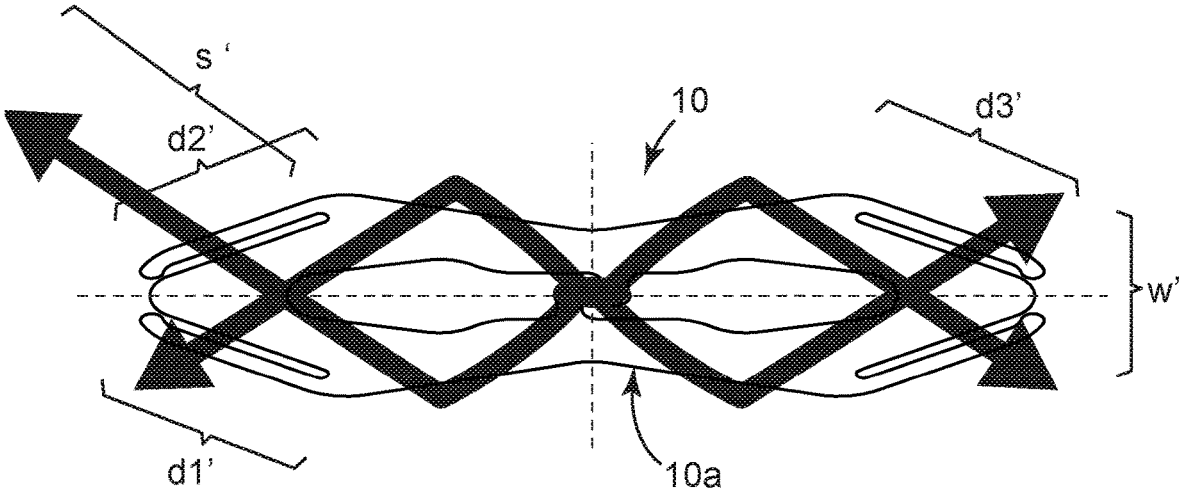
FIG. 8 is a schematic top view of the deformable element of the shock absorber assembly as shown in FIG. 1 with the deformable element being in a deformed condition.
Figure 9:
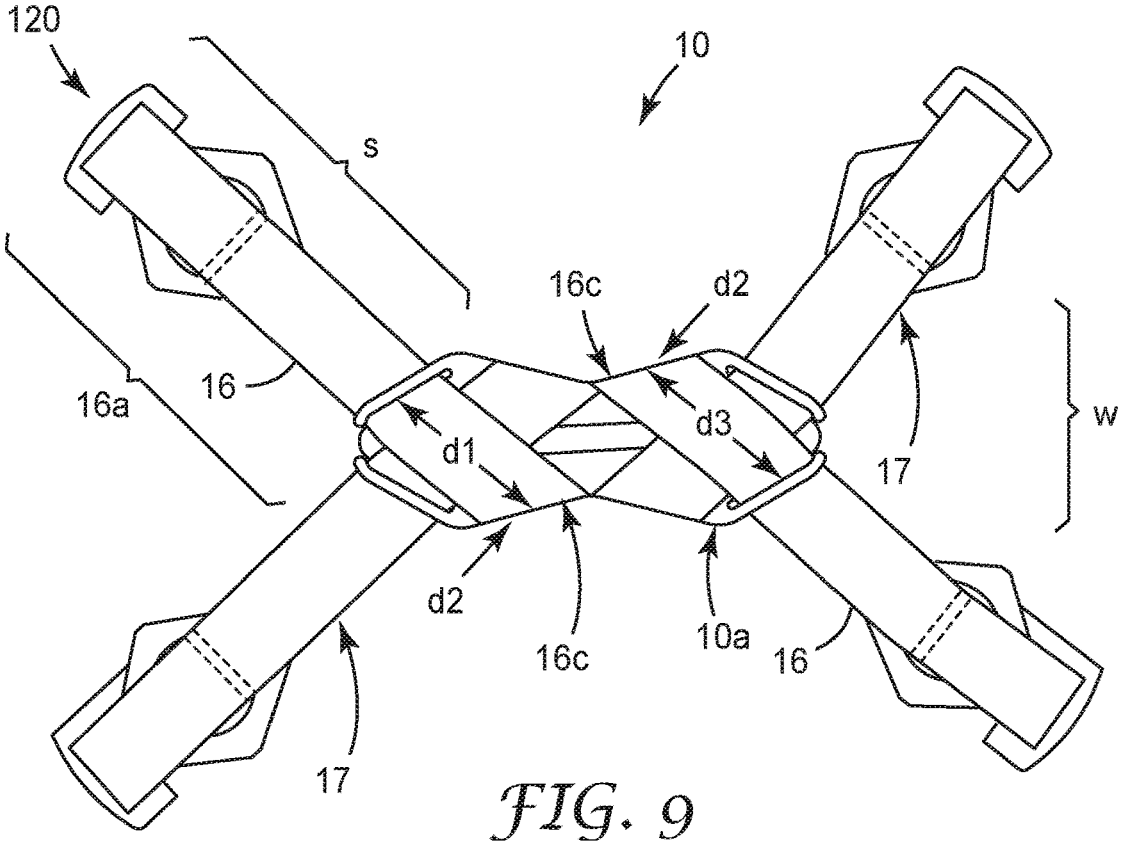
FIG. 9 is a schematic top view of the shock absorber assembly assembled with two flexible straps as shown in FIG. 2 with the deformable element being in a non-deformed condition.
Figure 10:
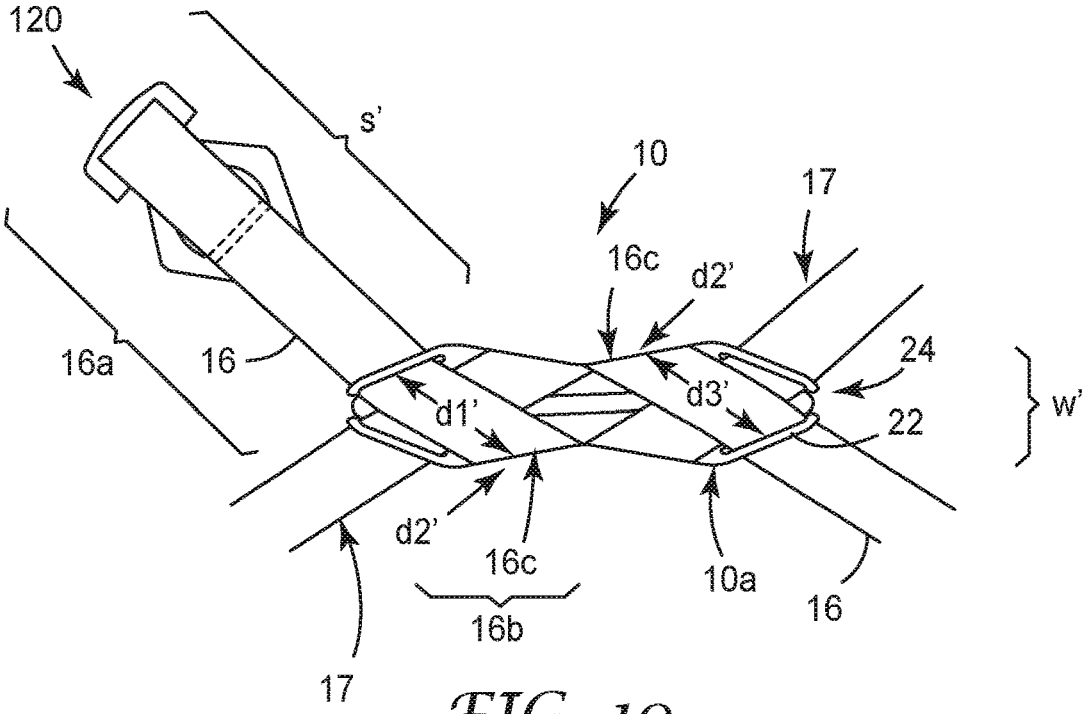
FIG. 10 is a schematic top view of the shock absorber assembly assembled with two flexible straps as shown in FIG. 2 with the deformable element being in a deformed condition.
Figure 11:
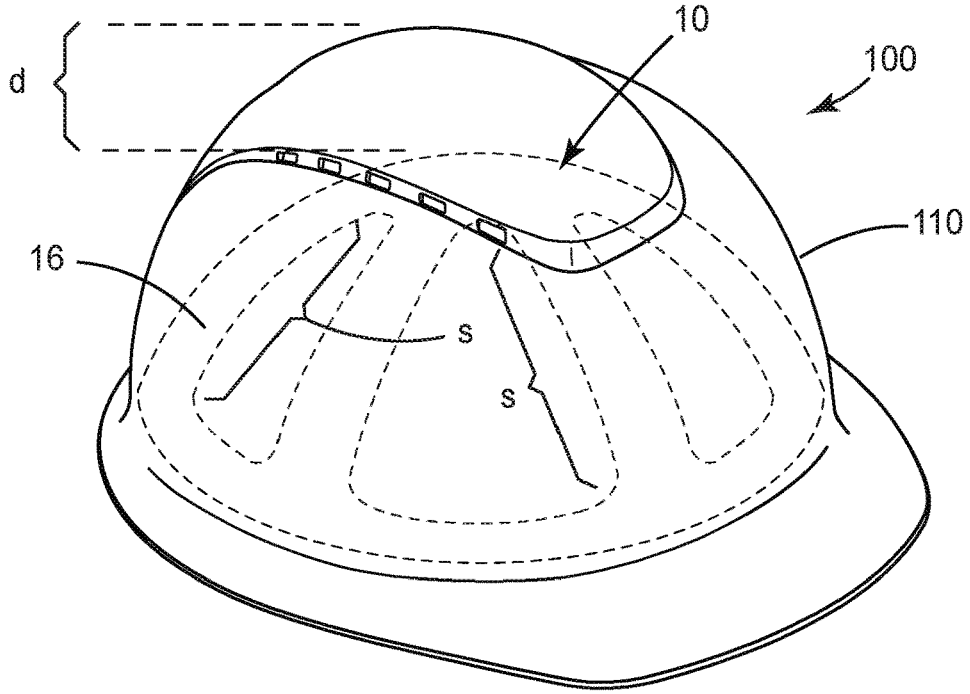
FIG. 11 is a schematic perspective view of a protective helmet with the shock absorber assembly according to the present disclosure with the deformable element being in a non-deformed condition.
Figure 12:
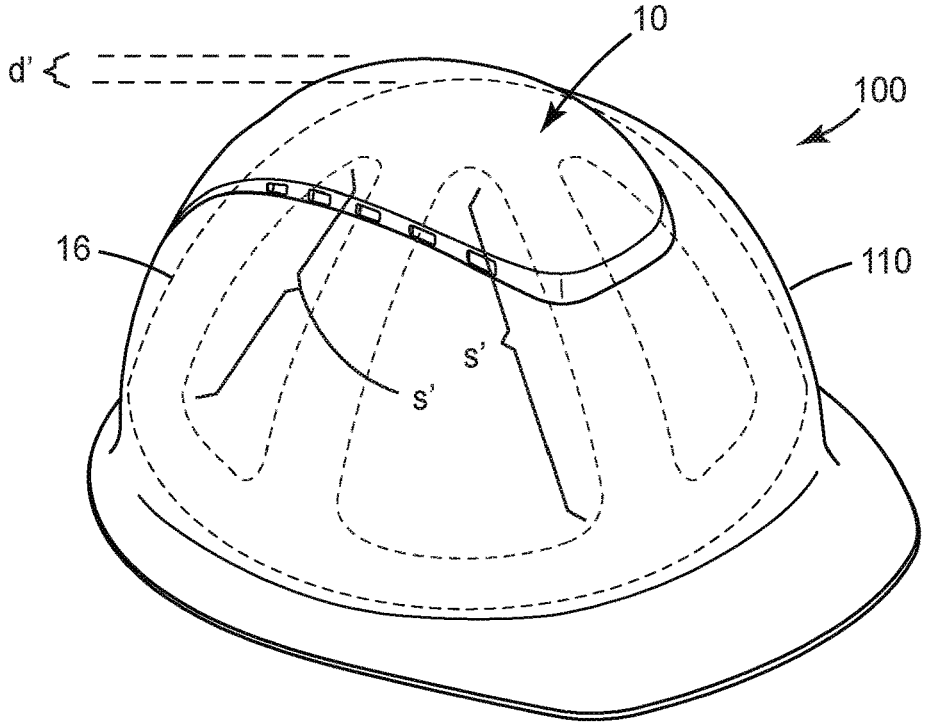
FIG. 12 is a schematic perspective view of a protective helmet with the shock absorber assembly according to the present disclosure with the deformable element being in a deformed condition.
Figure 13:
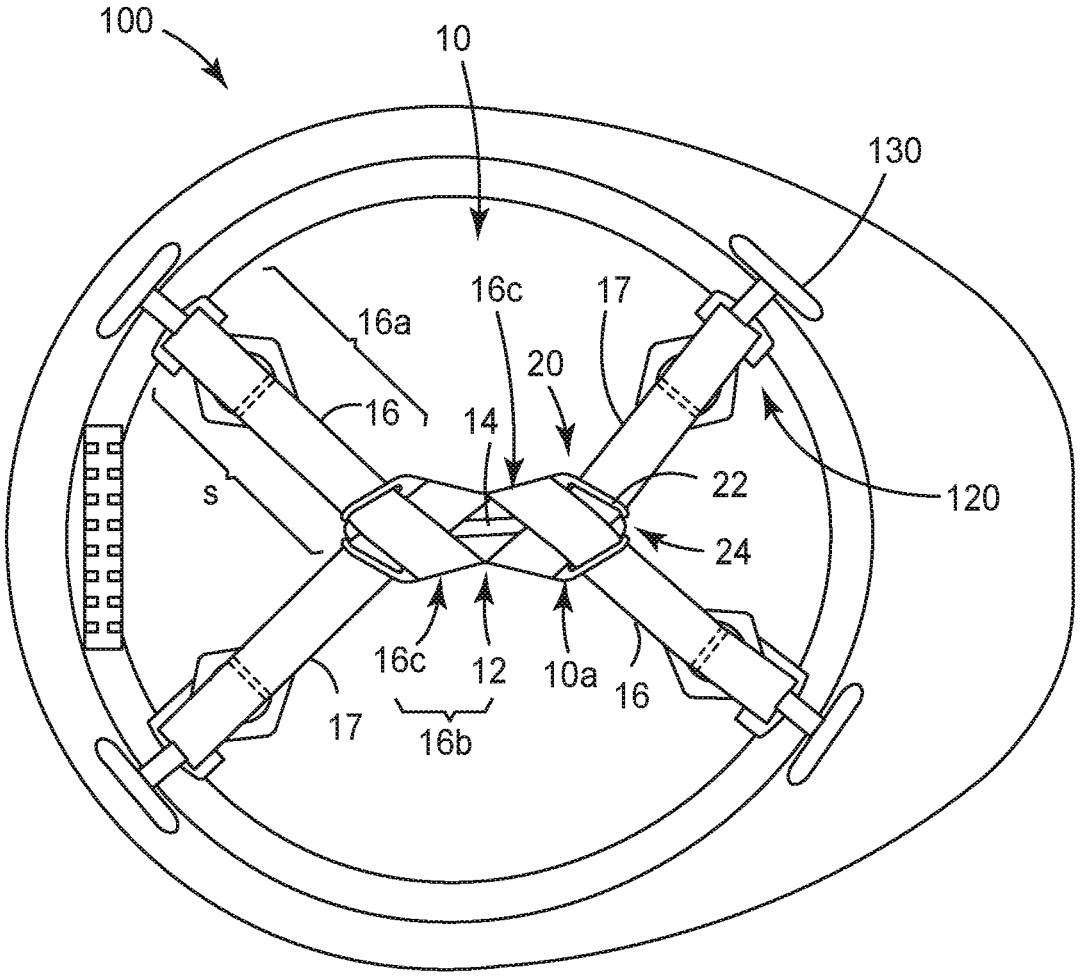
FIG. 13 is a schematic bottom view of a protective helmet with the shock absorber assembly according to the present disclosure with the flexible straps attached to the hard shell of the protective helmet.
Figure 14:
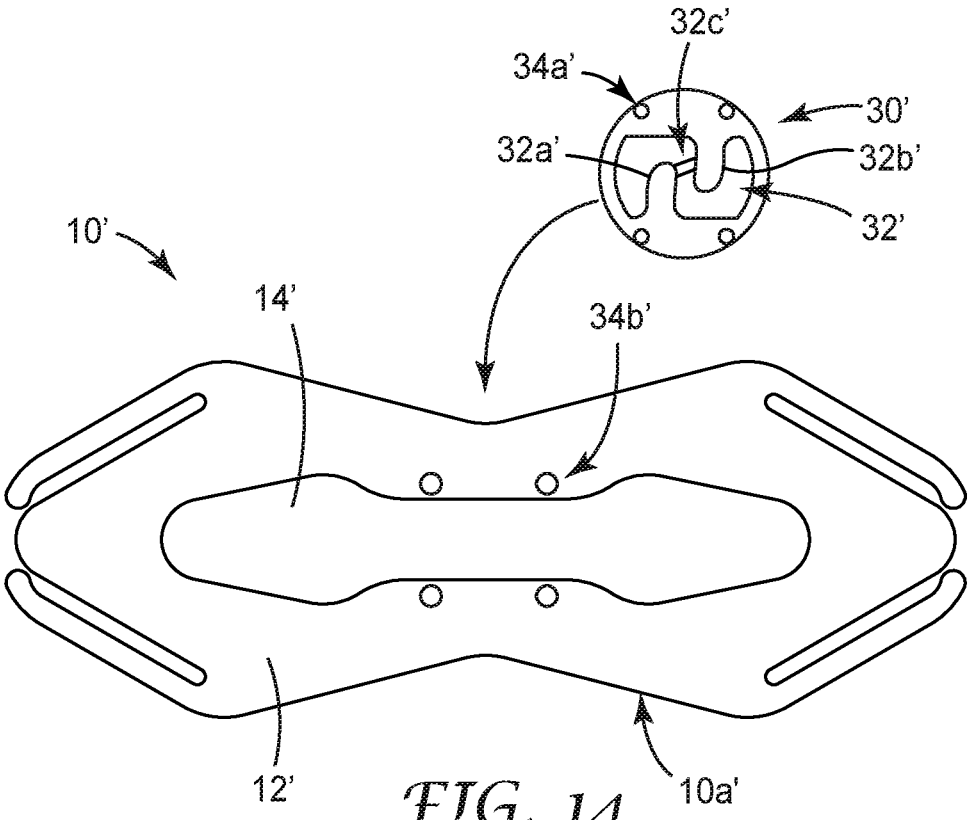
FIG. 14 is a schematic top view of the deformable element of the shock absorber assembly according to another embodiment and an indicator attachable thereto.
Figure 15:
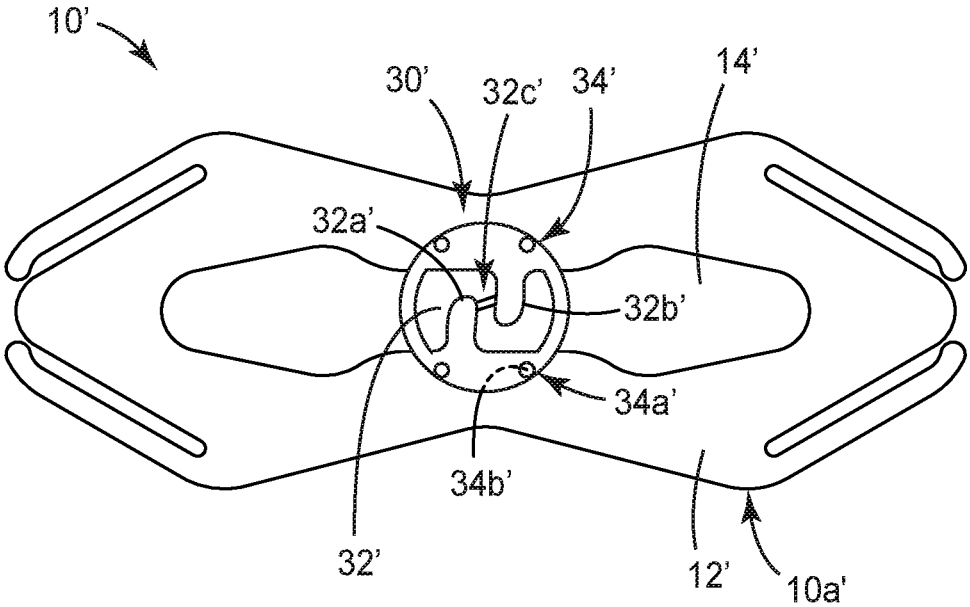
FIG. 15 is a schematic top view of the deformable element of the shock absorber assembly as shown in FIG. 14 with the indicator attached thereto.
Figure 16A:
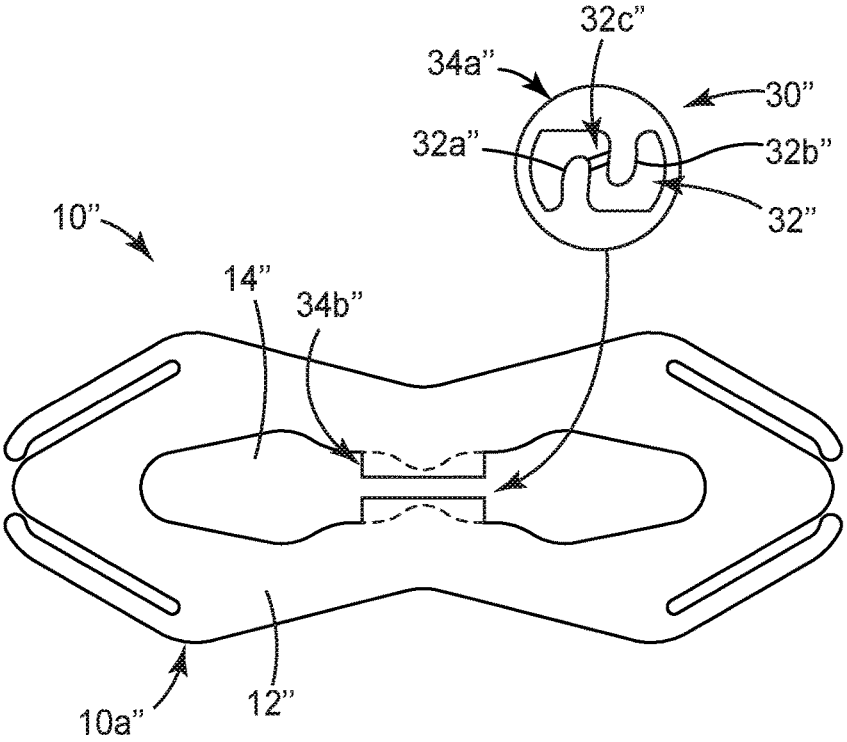
FIG. 16A is a schematic top view of the deformable element of the shock absorber assembly according to another embodiment and an indicator attachable thereto.
Figure 16B:
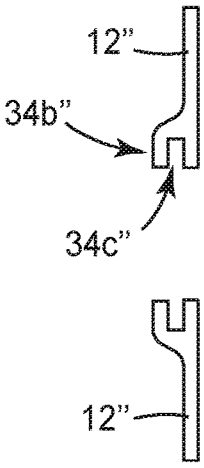
FIG. 16B is a cross-sectional view of the deformable element of the shock absorber assembly as shown in FIG. 16A.
Figure 17A:
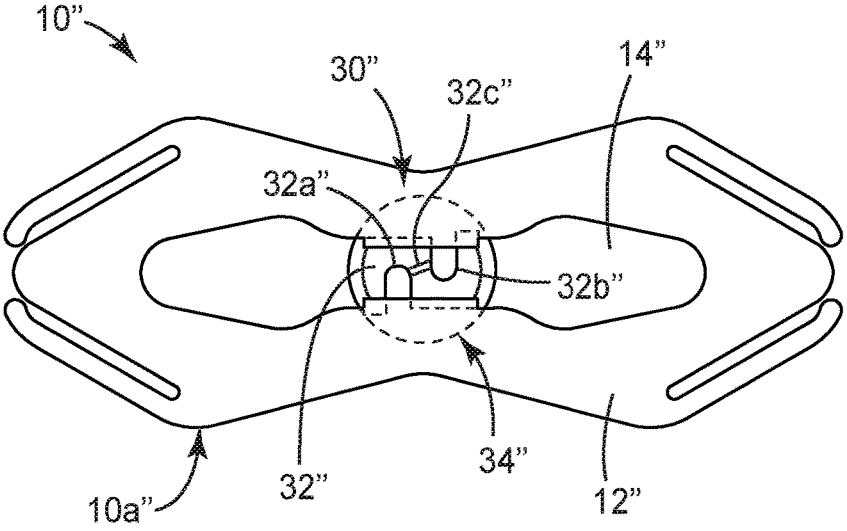
FIG. 17A is a schematic top view of the deformable element of the shock absorber assembly as shown in FIG. 14 with the indicator attached thereto.
Figure 17B:
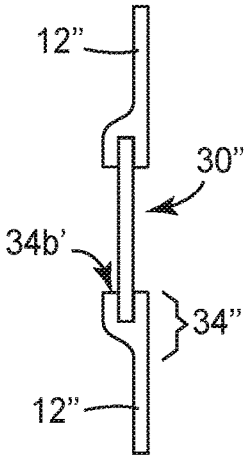
FIG. 17B is a cross-sectional view of the deformable element of the shock absorber assembly as shown in FIG. 17A.
Figure 18A:
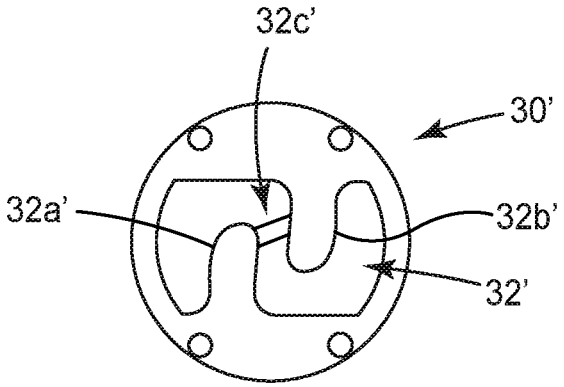
FIG. 18A is a schematic top view of the indicator of the shock absorber assembly according to an embodiment of the present disclosure as shown in FIGS. 14 and 15, in a first condition
Figure 18B:
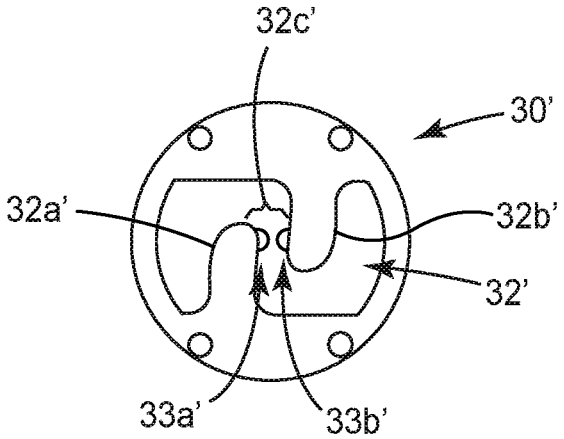
FIG. 18B is a schematic top view of the indicator of the shock absorber assembly according to an embodiment of the present disclosure as shown in FIGS. 14 and 15, in a second condition.

The invention claimed is:

1. A shock absorber assembly for a personal protective equipment, the shock absorber assembly comprising:

a deformable element exhibiting a mechanical resistance against deformation and a flexible strap comprising a middle portion and two free end portions facing away from each other, wherein the middle portion is tightly wrapped around the deformable element such that pulling the free end portions away from each other deforms the deformable element; wherein the strap comprises a twisted portion when wrapped around the deformable element such that the strap exhibits a 180 degrees twist at the deformable element, wherein the strap preferably comprises two twisted portions.

2. The shock absorber assembly of claim 1, wherein the deformable element exhibits an elongated shape having a length (l), a width (w) perpendicular to the length (l), a thickness (t) perpendicular to the length (l) and the width (w) and support distances arranged on the deformable element for supporting the strap, wherein the deformable element can be brought from a non-deformed condition with the length (l), the thickness (t), the width (w) and the support distances to a deformed condition with the length (l), the thickness (t'), the width (w') and the support distances, such that the length (l) is smaller than length (l), the width (w') is smaller than the width (w), the support distance (d1') is smaller than the support distance (d1), the support distance (d2') is smaller than the support distance (d2) and/or the support distance (d3') is smaller than the support distance (d3').

3. The shock absorber assembly of claim 1, wherein the deformable element comprises a main body and an opening formed therein, wherein the main body and/or the opening are deformed upon deformation of the deformable element.

4. The shock absorber assembly of claim 1, wherein the middle portion is supported by the deformable element.

5. The shock absorber assembly of claim 1, wherein the two free end portions each protrude from the deformable element.

6. The shock absorber assembly of claim 1, wherein the deformable element comprises strap guide for guiding the strap at the deformable element, wherein the strap guide preferably comprises a guiding arm arranged such that a slot for receiving the strap is formed between the guiding arm and the main body of the deformable element.

7. The shock absorber assembly of claim 1, comprising two flexible straps each comprising a middle portion and two free end portions facing away from each other, wherein the middle portion is tightly wrapped around the deformable element such that pulling the free end portions away from each other deforms the deformable element, wherein the middle portions of the two straps at least partially overlap with each other.

8. The shock absorber assembly according to claim 1, wherein the deformable element comprises a resilient material and wherein the deformation of the deformable element is reversible.

9. The shock absorber assembly of claim 1, wherein the deformable element comprises a brittle material and wherein the deformation of the deformable element is irreversible.

10. The shock absorber assembly of claim 1, comprising an indicator for indicating a deformation of the deformable element.

11. A protective helmet, a welding helmet, a face shield or a respiratory device comprising a hard shell and a shock absorber assembly of claim 1, wherein the hard shell of the protective helmet comprises an attachment for connecting the strap of the shock absorber to the hard shell.

* * * * *